US010165625B2

(12) United States Patent
Lim

(10) Patent No.: US 10,165,625 B2
(45) Date of Patent: Dec. 25, 2018

(54) COOKING APPLIANCE AND CONTROLLING METHOD THEREOF

(71) Applicant: LG ELECTRONICS INC., Seoul (KR)

(72) Inventor: Jaenam Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 280 days.

(21) Appl. No.: 15/152,282

(22) Filed: May 11, 2016

(65) Prior Publication Data

US 2016/0338150 A1 Nov. 17, 2016

(30) Foreign Application Priority Data

May 12, 2015 (KR) ..... 10-2015-0065905

(51) Int. Cl.

| | |
|---|---|
| ***H05B 3/68*** | (2006.01) |
| ***H05B 1/02*** | (2006.01) |
| ***H05B 6/68*** | (2006.01) |
| ***H05B 6/06*** | (2006.01) |

(52) U.S. Cl.

CPC ..... *H05B 1/0266* (2013.01); *H05B 1/0258* (2013.01); *H05B 3/68* (2013.01); *H05B 6/062* (2013.01); *H05B 6/687* (2013.01)

(58) Field of Classification Search

CPC ..... H05B 1/0258–1/0266; H05B 3/68–3/683; H05B 6/062–6/065; H05B 6/12–6/129; H05B 6/687; F24C 7/08–7/088

USPC ..... 219/620, 626, 391, 395, 396, 443.1, 219/445.1, 446.1

See application file for complete search history.

(56) References Cited

U.S. PATENT DOCUMENTS

| | | | | |
|---|---|---|---|---|
| 4,633,067 | A * | 12/1986 | Payne | F24C 7/083 219/483 |
| 7,368,686 | B2 * | 5/2008 | Etheredge | F24C 7/087 219/394 |
| 8,890,042 | B2 * | 11/2014 | Uchida | H05B 6/06 219/626 |

(Continued)

FOREIGN PATENT DOCUMENTS

| | | |
|---|---|---|
| JP | 10-125459 A | 5/1998 |
| JP | 11-144590 A | 5/1999 |

(Continued)

*Primary Examiner* — Michael Laflame, Jr.

(74) *Attorney, Agent, or Firm* — Dentons US LLP

(57) ABSTRACT

Disclosed is a cooking appliance. The present invention includes a plurality of loads connected in parallel with each other, a plurality of load relays configured to be connected in series to a plurality of the loads in order to selectively supply commercial electricity supplied from a power supply unit to a plurality of the loads, respectively and be driven selectively in ON or OFF state, a safety relay configured to be connected in series to a plurality of the loads and be driven selectively in ON or OFF state, a detecting unit configured to sense a voltage applied to both ends of the safety relay by being connected to the safety relay, and a controller configured to control a plurality of the load relays, the safety relay and the detecting unit and determine a presence or non-presence of malfunction of a plurality of the load relays based on a signal from the detecting unit.

20 Claims, 6 Drawing Sheets

(56) References Cited

U.S. PATENT DOCUMENTS

| | | | | |
|---|---|---|---|---|
| 2009/0294434 | A1* | 12/2009 | Fonseca | H05B 1/0263 219/498 |
| 2011/0114627 | A1* | 5/2011 | Burt | F24C 7/087 219/396 |
| 2011/0303653 | A1* | 12/2011 | Chun | H05B 6/062 219/624 |
| 2012/0321762 | A1* | 12/2012 | Aranda Vazquez | H05B 6/062 426/231 |
| 2013/0248517 | A1* | 9/2013 | Moon | H05B 6/1272 219/626 |
| 2014/0014647 | A1* | 1/2014 | Brosnan | H05B 6/062 219/600 |
| 2016/0029439 | A1* | 1/2016 | Kurose | H05B 6/065 219/626 |

FOREIGN PATENT DOCUMENTS

| | | | |
|---|---|---|---|
| KR | 10-0239511 | B1 | 3/2000 |
| KR | 10-0258381 | B1 | 6/2000 |

* cited by examiner

COOKING APPLIANCE AND CONTROLLING METHOD THEREOF

Pursuant to 35 U.S.C. § 119(a), this application claims the benefit of earlier filing date and right of priority to Korean Application No. 10-2015-0065905, filed on May 12, 2015, the contents of which are hereby incorporated by reference herein in their entirety.

BACKGROUND OF THE INVENTION

1. Field of the Invention

The present invention relates to a cooking appliance, and more particularly, to a cooking appliance and controlling method thereof. Although the present invention is suitable for a wide scope of applications, it is particularly suitable for detecting and displaying malfunction of a relay included in an electronic control device configured to supply electricity to a heating unit of the cooking appliance.

2. Discussion of the Related Art

Generally, cooking appliances may mean products configured to cook food using electricity or other energy (e.g., gas, etc.) at home or room.

Among those cooking appliances, the cooking appliances using gas as heat source include a gas range, a gas oven, a gas oven range and the like and the cooking appliances using electricity as heat source include an induction range, a radiant heater using electric range, an electronic range and the like. Moreover, there is a combined cooking appliance in which an electricity-used induction range and a gas-used gas oven are combined with each other.

For instance, in case of an electric range using a radiant heater, commercial electricity or power may be supplied to loads of a heating coil, a fan motor and the like under the control of a controller. Particularly, as a relay connected between the commercial electricity and the load is driven in ON or OFF state, the commercial electricity or power can be selectively applied to the load.

In particular, based on user's control command input, the controller can selectively drive a relay connected to each of a plurality of loads.

For instance, Korean Patent No. 0258381 (hereinafter called 'related art') discloses a circuit structure capable of checking malfunction of such a relay.

In particular, the related art is configured to determine a presence or non-presence of malfunction of a relay connected to a load by sensing a voltage between both ends of the corresponding load.

However, according to the related art, since the voltage between both of the ends of the load, if a plurality of loads are applied, a plurality of voltage sensing units (e.g., voltage sensing circuit such as photo coupler, etc.) amounting to the number of the loads are required.

In case that a plurality of voltage sensing units (e.g., voltage sensing circuit such as photo coupler, etc.) amounting to the number of the loads are applied, the number of connection points increases.

In case that a relay connected to a load malfunctions (e.g., short-circuit), although the malfunction of the relay can be detected, it is impossible to stop the drive of the load due to the malfunction of the relay.

Eventually, if the malfunction of the relay occurs, as power continues to be supplied to the load unintentionally, it may cause a problem of outbreak of fire.

SUMMARY OF THE INVENTION

Accordingly, embodiments of the present invention are directed to a cooking appliance that substantially obviates one or more problems due to limitations and disadvantages of the related art.

One object of the present invention is to provide a cooking appliance, by which malfunctions of a plurality of relays respectively connected to a plurality of loads can be detected through a single voltage sensing unit despite that a plurality of the loads are applied.

Another object of the present invention is to provide a cooking appliance, by which the number of connection points attributed to connection with a voltage sensing unit can be minimized irrespective of the number of the applied loads.

In case that a relay connected to a load is short-circuited, another object of the present invention is to provide a cooking appliance, by which the load can stop being driven as soon as short circuit of the relay is detected.

Another object of the present invention is to provide a cooking appliance, by which the outbreak of fire due to short circuit of a relay can be prevented.

In case that a relay connected to a load is not functional, further object of the present invention is to provide a cooking appliance, which is capable of detecting whether the relay is not functional.

Technical tasks obtainable from the present invention are non-limited by the above-mentioned technical tasks. And, other unmentioned technical tasks can be clearly understood from the following description by those having ordinary skill in the technical field to which the present invention pertains.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, a cooking appliance according to one embodiment of the present invention may include a plurality of loads connected in parallel with each other, a plurality of load relays configured to be connected in series to a plurality of the loads in order to selectively supply commercial electricity supplied from a power supply unit to a plurality of the loads, respectively and be driven selectively in ON or OFF state, a safety relay configured to be connected in series to a plurality of the loads and be driven selectively in ON or OFF state, a detecting unit configured to sense a voltage applied to both ends of the safety relay by being connected to the safety relay, and a controller configured to control a plurality of the load relays, the safety relay and the detecting unit and determine a presence or non-presence of malfunction of a plurality of the load relays based on a signal from the detecting unit.

The cooking appliance may further include a display unit configured to display the presence or non-presence of the malfunction of the load relay based on a signal from the controller.

In an operating mode of the cooking appliance, if a preset voltage is sensed by the detecting unit in a relay resting interval having all load relays controlled to be turned off, the controller may control the display unit to display a malfunction indication.

The cooking appliance may further include a power supply unit configured to supply power toward the load and the controller may control the power supply unit to stop a drive of the power supply unit after displaying the malfunction indication on the display unit.

In a diagnosing mode of the cooking appliance, if a preset voltage is sensed by the detecting unit in an operating state having all load relays controlled to be turned off, the controller may control the display unit to display a malfunction indication.

After a control signal for turning off a load relay connected to a specific load has been inputted, if a voltage of 0 V is sensed by the detecting unit in a state that the safety relay is turned off, the controller may control the display unit to display information on malfunction of the load relay connected to the specific load.

A plurality of the loads and a plurality of the load relays may configure a load driving unit, and a single safety relay may be connected in series to the load driving unit at a front or rear end of the load driving unit.

The detecting unit may include a voltage sensing unit configured to sense a voltage between both ends of the safety relay by being connected in parallel with the safety relay.

In another aspect of the invention, as embodied and broadly described herein, in a cooking appliance including a plurality of loads connected in parallel with each other, a plurality of load relays connected in series to the corresponding loads, respectively, a single safety relay connected in series to a plurality of the loads, and a detecting unit configured to sense malfunction of a plurality of the load relays by being connected to the safety relay, a method of controlling the cooking appliance according to one embodiment of the present invention may include a mode inputting step of inputting either an operating mode or a diagnosing mode, a malfunction determining step of determining a presence or non-presence of malfunction of a plurality of load relays based on the inputted mode, and a displaying step of selectively displaying the presence or non-presence of the malfunction based on a result of the determination in the malfunction determining step.

If a specific operating mode is inputted in the mode inputting step, the malfunction determining step may include a relay operation controlling step of driving at least one of a plurality of the load relays and the single safety relay in the inputted operating mode selectively, a resting interval determining step of determining whether it is a resting interval in which a plurality of the load relays and the safety relay are entirely turned off, and a first voltage detection determining step of if the resting interval is determined, determining whether a preset voltage is sensed by the detecting unit.

If the preset voltage is sensed by the detecting unit in the first voltage detection determining step, information on relay load malfunction may be displayed on the display unit in the displaying step.

The information on the load relay malfunction displayed on the display unit may include a relay short-circuit state.

The method may further include a drive stopping step of if the information on the relay load malfunction is displayed on the display unit in the displaying step, stopping a drive of a power supply unit configured to supply power to the cooking appliance.

If a diagnosing mode is inputted in the mode inputting step, the malfunction determining step may include a relay OFF step of turning off a plurality of the load relays and the single safety relay and a second voltage detection determining step of determining whether a preset voltage is sensed by the detecting unit.

If the preset voltage is sensed by the detecting unit in the second voltage detection determining step, information on relay load malfunction may be displayed on the display unit in the displaying step.

The information on the load relay malfunction displayed on the display unit may include a relay short-circuit state.

The malfunction determining step may further include a load relay ON step of if the voltage sensed by the detecting unit is 0 V in the second voltage detection determining step, inputting a signal for turning on a first load relay among a plurality of the load relays and a third voltage detection determining step of determining whether a preset voltage is sensed by the detecting unit.

If a voltage sensed by the detecting unit is 0 in the third voltage detection determining step, information on relay load malfunction may be displayed on the display unit in the displaying step.

The information on the load relay malfunction displayed on the display unit may include a load relay non-actuation state.

If the preset voltage is sensed by the detecting unit in the third voltage detection determining step, after a signal for turning off the first load relay and turning on the second load relay has been inputted, the third voltage detection determining step may be entered.

Particularly, in the third voltage detection determining step, the determination of a presence or non-presence of malfunction for each load relay can be performed iteratively and sequentially.

Accordingly, embodiments of the present invention provide various effects and/or features.

First of all, the present invention can provide a cooking appliance capable of detecting which malfunctions of a plurality of relays respectively connected to a plurality of loads can be detected through a single voltage sensing unit despite that a plurality of the loads are applied.

Secondly, the present invention can provide a cooking appliance capable of minimizing the number of connection points attributed to connection with a voltage sensing unit irrespective of the number of the applied loads.

Thirdly, in case that a relay connected to a load is short-circuited, the present invention can provide a cooking appliance, by which the load can stop being driven as soon as short circuit of the relay is detected.

Fourthly, the present invention can provide a cooking appliance capable of preventing the outbreak of fire due to short circuit of a relay.

Fifthly, in case that a relay connected to a load is not functional, the present invention can provide a cooking appliance capable of detecting whether the relay is not functional.

Effects obtainable from the present invention may be non-limited by the above mentioned effect. And, other unmentioned effects can be clearly understood from the following description by those having ordinary skill in the technical field to which the present invention pertains.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. The above and other aspects, features, and advantages of the present invention will become more apparent upon consideration of the following description of preferred embodiments, taken in conjunction with the accompanying drawing figures. In the drawings.

DETAILED DESCRIPTION OF THE INVENTION

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention.

Wherever possible, the same reference numbers will be used throughout the drawings to refer to the same or similar parts, of which redundant details shall be omitted. For clarity of the description, a size and shape of each configuration member can be exaggerated or reduced.

Figure 1:
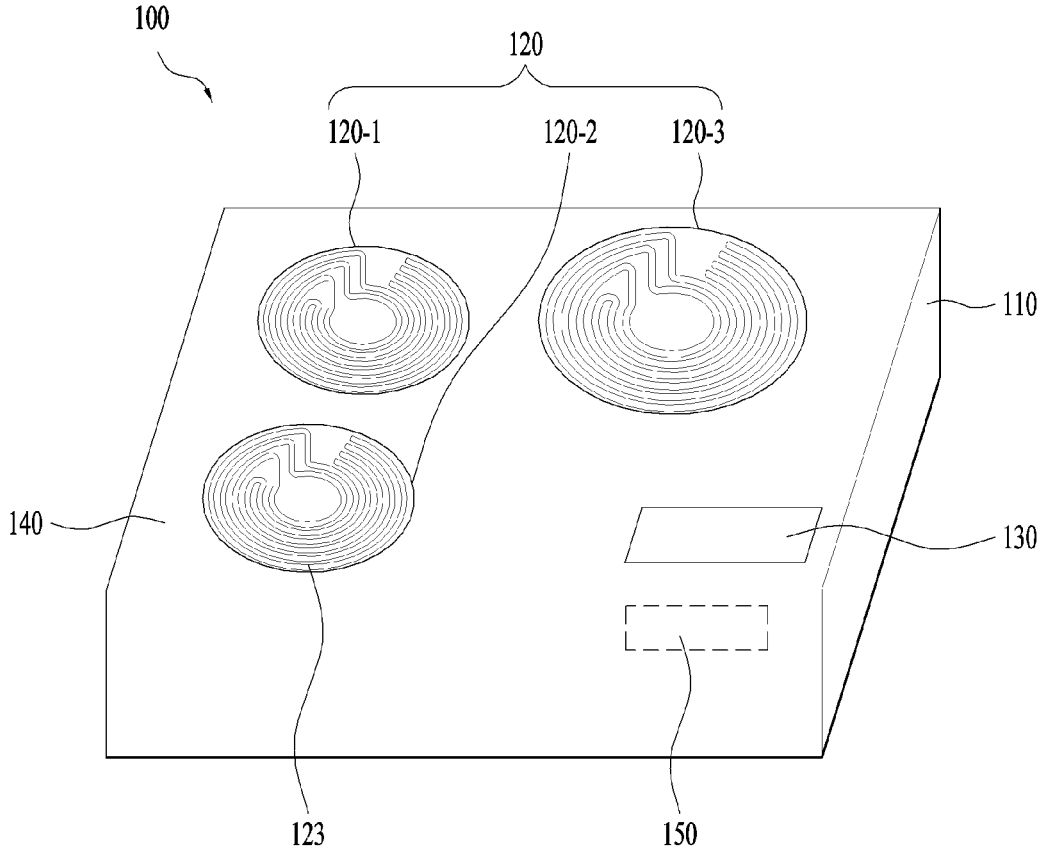
FIG. 1 is a schematic perspective diagram of a cooking appliance according to an embodiment of the present invention.

FIG. 1 is a schematic perspective diagram of a cooking appliance according to an embodiment of the present invention.

Referring to FIG. 1, a cooking appliance 100 according to an embodiment of the present invention may include a cabinet 110 forming an exterior, at least one cooking unit 120 (hereinafter named 'load') coupled with the cabinet 110, a display unit 130 configured to display cooking information by being provided to the cabinet 110, a glass unit 140 provided to a top side of the cabinet 110, and a controller 150 configured to control the cooking unit 120 and the display unit 130 by being provided within the cabinet 110.

The cabinet 110 is configured in a hexahedral shape in the embodiment shown in the drawing, by which a shape of the cabinet 100 is non-limited.

The at least one cooking unit 120 may include a first cooking unit 120-1, a second cooking unit 120-2 and a third cooking unit 120-3. In particular, the cooking appliance 100 according to an embodiment of the present invention may include a plurality of the cooking units 120.

In the following description, the cooking unit 120 may be named 'load' of the cooking appliance 100 that uses electricity.

The display unit 130 may be configured to display cooking information. For instance, the cooking information may include a cooking time, a temperature of the cooking unit 120 and the like.

The display unit 130 may be configured to apply an input of a control command for a control of the cooking unit 120. For instance, the display unit 130 may have a touch panel configuration. Hence, through a touch to the display unit 130, a user can input a control command of the cooking unit 120.

The glass unit 140 may be provided onto the cabinet 110 to cover a top side of the cooking unit 120. Since the configuration of the glass unit 140 is well known to the public in association with an electric range, its details shall be omitted.

Based on signals inputted through the display unit 130, the controller 150 may be configured to control the cooking unit 120. And, the controller 150 can control the display unit 130 to display cooking information thereon.

Meanwhile, according to an embodiment of the present invention, the cooking unit 120 may include a radiant heater. And, a structure of the cooking unit 120 shall be described with reference to other drawings as follows.

Figure 2:
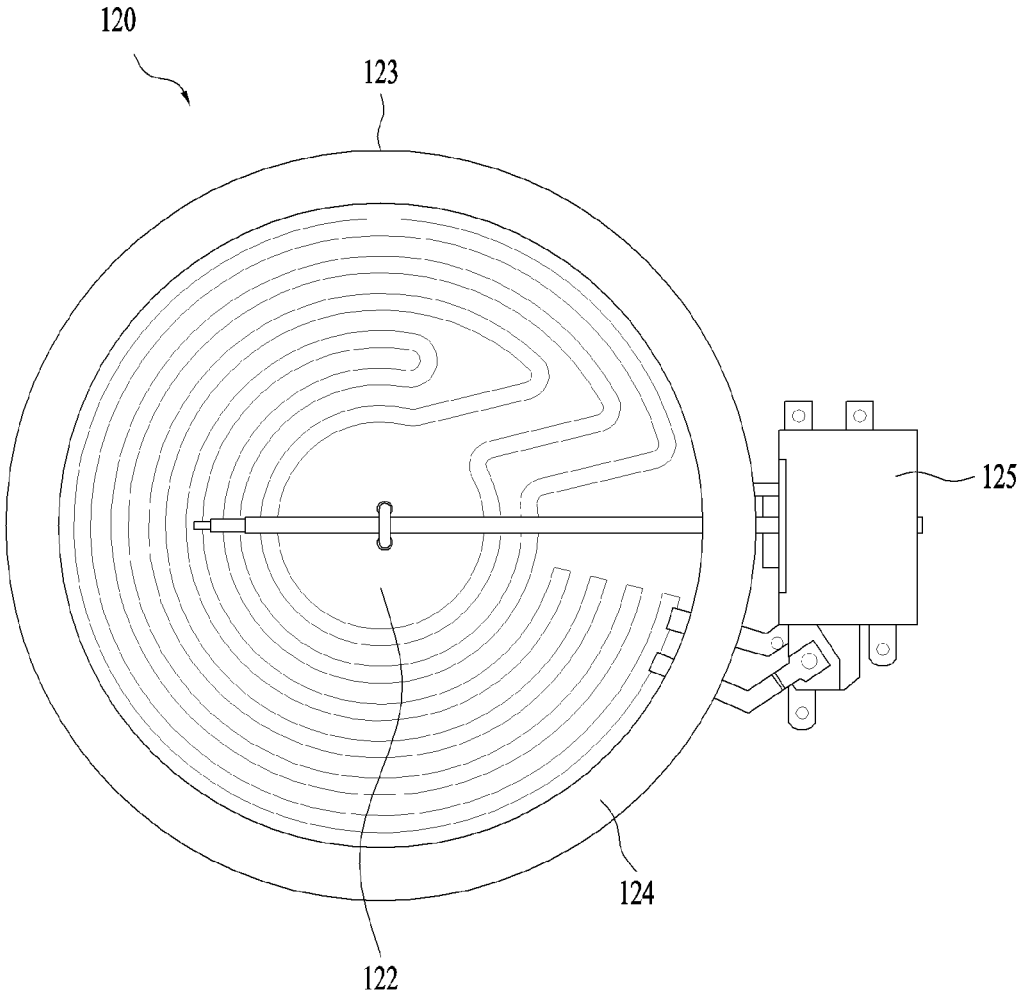
FIG. 2 is a diagram of a cooking unit (i.e., radiant heater) applied to the cooking appliance shown in FIG. 1.
Figure 3:
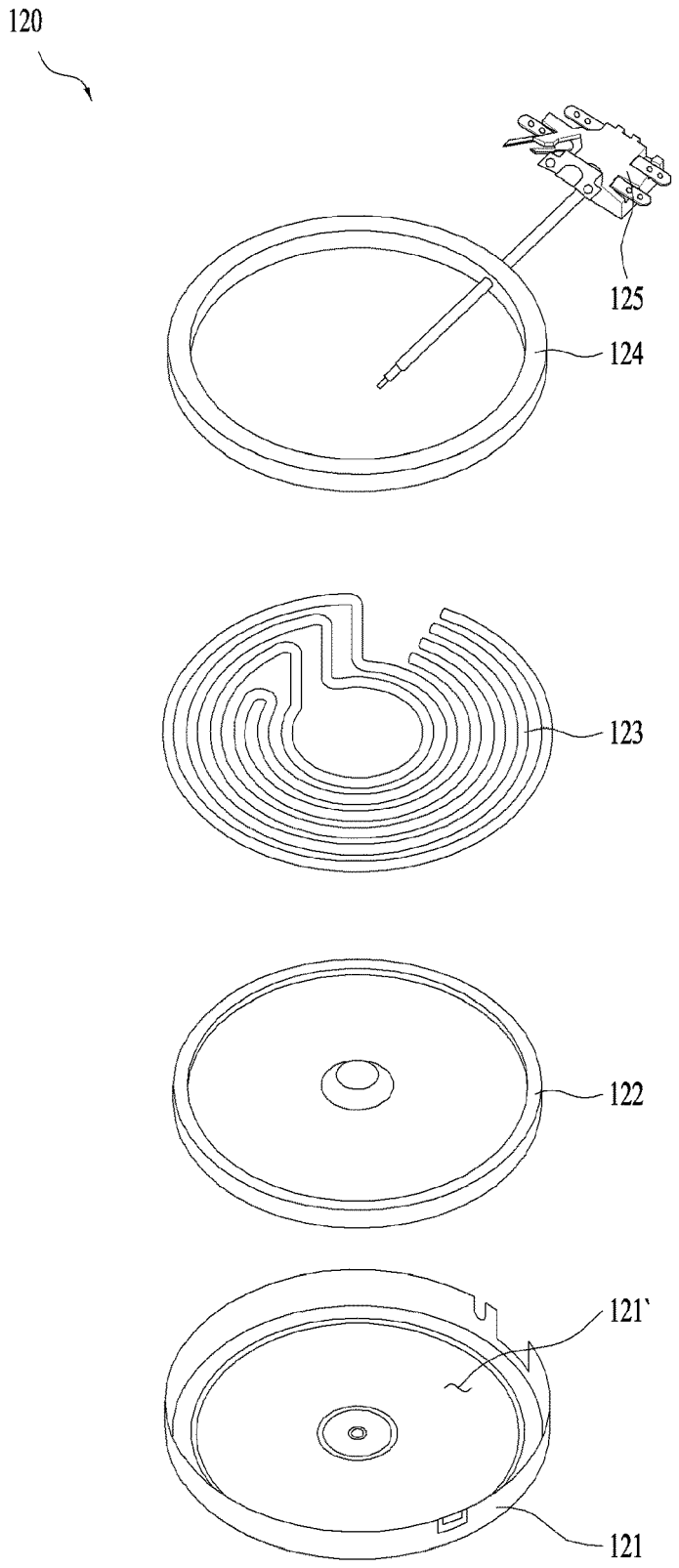
FIG. 3 is an exploded perspective diagram of a cooking unit shown in FIG. 2.

FIG. 2 is a diagram of a radiant heater applied to the cooking appliance shown in FIG. 1, and FIG. 3 is an exploded perspective diagram of the radiant heater shown in FIG. 2.

Referring to FIG. 2 and FIG. 3, the cooking unit 120 applied to the cooking appliance 100 according to an embodiment of the present invention may include a base plate 121, an insulating plate 122 seated on the base plate 121, a heater coil 123 provided onto the insulating plate 122, an insulating ring 124 configured to enclose a circumference of the heater coil 123 on the insulating plate 122, and a thermostat 125 coupled with the insulating ring 123.

The base plate 121 is configured to support a bottom of the cooking unit 120. According to the embodiment shown in the drawing, the base plate 121 may have a cylindrical shape of which top side is open. In particular, the base plate 121 may have a circular receiving part 121' in preset height.

The insulating plate 122 can be seated on the base plate 121 through the open top side of the base plate 121. In particular, the insulating plate 122 can be seated within the circular receiving part 121' provided to the base plate 121. And, the insulating plate 122 plays a role in preventing the heat generated from the heater coil 123 described in the following from being transferred toward a bottom side of the cooking unit 120.

The heater coil 123 may be disposed on the insulating plate 122. And, the heater coil 123 can be configured to generate heat by being supplied with power from an external power supply unit (not shown in the drawing).

The insulating ring 124 can be disposed on the insulating plate 122. In particular, the heater coil 123 and the insulating ring 124 can be disposed on the insulating plate 122. In more particular, the insulating ring 124 can be configured to enclose an outer circumference of the heater coil 123 in a radial direction.

Hence, the insulating ring 124 plays a role in preventing the heat generated from the heater coil 123 from being transferred to a radial outside (i.e., a circumferential outside) of the cooking unit 120.

The thermostat 125 senses a temperature of the cooling unit 120 and is able to control the temperature of the cooking unit 120 to maintain a preset temperature. In particular, the thermostat 125 senses the temperature of the cooking unit 120 attributed to the heat generated from the heater coil 123 and is able to control a power supply unit (not shown in the drawing) in order for the temperature of the cooking unit 120 to maintain the preset temperature.

In particular, the thermostat 125 may include a rod thermostat configured to extend from a circumferential outside of the insulating ring 124 to a circumferential inside of the insulating ring 124 by perforating one side of the insulating ring 124.

Since the configuration and function of the thermostat 125 are known to the public in general, their details shall be omitted.

Meanwhile, the cooking unit 120 may function as a load of the cooking appliance 100 that uses electricity. And, a relay configured to selectively apply power to the cooking unit 120 may be connected to the cooking unit 120.

Malfunction of the relay may cause a problem that the cooking appliance 110 is driven in an unintended direction.

Configuration for detecting malfunction of the relay connected to the cooking unit 120 and configuration for controlling a drive of the cooking appliance 100 according to the malfunction of the relay are described with reference to other drawings as follows.

Figure 4:
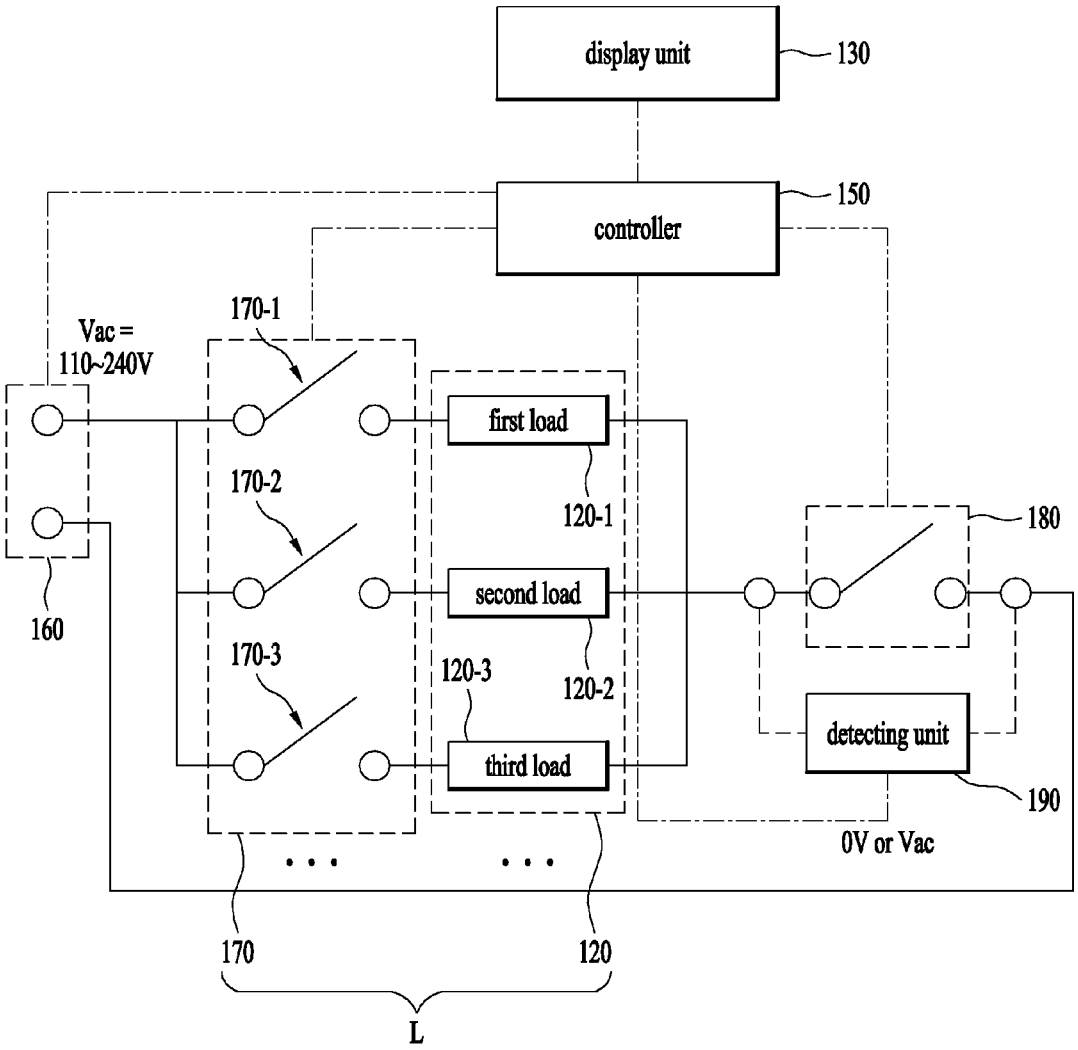
FIG. 4 is a schematic diagram for configuration of a malfunction detecting circuit according to one embodiment of the present invention.

FIG. 4 is a schematic diagram for configuration of a malfunction detecting circuit according to one embodiment of the present invention.

Referring to FIGS. 1 to 4 together, the cooking appliance 100 according to the embodiment of the present invention can include a plurality of loads 120. For instance, the cooking appliance 100 may include a first load 120-1, a second load 120-2 and a third load 120-3.

A plurality of the loads 120 may include the aforementioned cooking unit. Of course, in case that a fan (not shown) for heat release is provided to the cooking appliance 100, the fan can be included in the loads 120 as well.

A plurality of the loads 120 may be connected in parallel with each other. In particular, a plurality of the loads 120 can be configured to be electrically connected in parallel with each other.

The cooking appliance 100 according to the embodiment of the present invention may further include a plurality of load relays 170 connected to a plurality of the loads 120, respectively.

In particular, a plurality of the load relays 170 may be configured to selectively supply use power supplied from the power supply unit 160 to a plurality of the loads 120.

And, a plurality of the load relays 170 may be configured to be connected in series to the corresponding loads, respectively. In particular, each of a plurality of the load relays 170 can be configured to be connected in series to the corresponding load.

So to speak, since a plurality of the load relays 170 are formed to one-to-one correspond to a plurality of the loads 120, the number of a plurality of the load relays 170 may be equal to that of a plurality of the loads 120.

According to the embodiment shown in the drawing, a plurality of the loads 120 include the 1$^{st}$ load 120-1, the second load 120-2 and the third load 120-3. Hence, a plurality of the load relays 170 may include a first load relay 170-1 connected in series to the first load 120-1, a second load relay 170-2 connected in series to the second load 120-2 and a third load relay 170-3 connected in series to the third load 120-3.

The first to third load relays 170-1 to 170-3 can be turned on or off by the controller 150 so as to selectively supply power to the first to third loads 120-1 to 120-3, respectively.

Meanwhile, the cooking appliance 100 according to the embodiment of the present invention may include a safety relay 180 connected in series to a plurality of the loads 120 and a detecting unit 190 configured to sense a voltage of the safety relay 180 by being connected to the safety relay 180.

The safety relay 180 can be controlled to be selectively driven by the controller 150 in a manner of being connected in series to a plurality of the loads 120. In particular, the safety relay 180 can be connected in series to a plurality of the loads 120 at rear ends of a plurality of the loads 120 connected in parallel with each other.

For instance, a plurality of the loads 120 and a plurality of the load relays 170 can configure a load driving unit L. And, a single safety relay 180 can be connected in series to the load driving unit L at a rear end of the load driving unit L.

If at least one of a plurality of the load relays 170 is in ON state, the safety relay 180 can be controlled by the controller 150 so that the safety relay 180 is in ON state as well. Moreover, only if a plurality of the load relays 170 are entirely in OFF state, the safety relay 180 can be controlled by the controller 180 so that the safety relay 180 is in OFF state as well.

The detecting unit 190 may be configured to sense a voltage between both ends of the safety relay 180. For instance, the detecting unit 190 may become a voltage sensing unit connected in parallel to the safety relay 180.

Hence, compared to a case that a plurality of the detecting units are connected to a plurality of the load relays 170, respectively, the number of connection points for the connections of the detecting unit may decrease.

Moreover, the voltage applied between the safety relay 180 may become 0V or a voltage Vac of commercial electricity. The voltage Vac of the commercial electricity may become 110~220 V.

For instance, while at least one of a plurality of the load relays 170 is closed in ON state, the voltage Vac of the commercial electricity may be applied to both ends of the safety relay 180 open in OFF state.

In particular, if at least one of a plurality of the load relays 170 is closed in ON state and the safety relay 180 is open in OFF state, the detecting unit 190 can sense the voltage Vac of the commercial electricity.

On the other hand, while all of a plurality of the load relays 170 are open in OFF state, a voltage sensed between both ends of the safety relay 180 open in OFF state may become 0 V.

Meanwhile, the controller 150 may be configured to control a plurality of the load relays 170, the safety relay 180 and the detecting unit 190.

In particular, the controller 150 can be configured to determine a presence or non-presence of malfunction of a plurality of the load relays 170 based on signals from the detecting unit 190. Moreover, the controller 150 can be configured to be electrically connected to a display unit 130. In this case, the display unit 130 may be configured to display a presence or non-presence of the load relay 170 based on a signal from the controller 150.

In particular, if a preset voltage is sensed by the detecting unit 190 in an operating state that all load relays controlled to be in OFF state, the controller 150 can control the display unit 130 to display a malfunction indication.

For instance, the cooking appliance 100 may include an operating mode for detecting malfunction of a plurality of the load relays 170 in a state that the cooking appliance 100 is actuated by an external command and a diagnosing mode for detecting malfunction of a plurality of the load relays 170 in a non-actuated state of the cooking appliance 100.

For instance, the operating mode means a state that an actuation command of at least one of a plurality of the loads 120 is inputted by a user. In particular, the operating mode means that at least one of a plurality of the load relays 170 is selectively turned on in response to user's control command.

The diagnosing mode means a state that a diagnosis command for a plurality of the load relays is inputted by a user. Hence, in the diagnosing mode, an actuation command for the load 120 is not inputted separately.

In the operating mode of the cooking appliance 100, an actuated state (hereinafter named 'relay resting interval') in which all load relays including a plurality of the load relays 170 and the single safety relay 180 are controlled to be turned off may be included. And, the detecting unit 190 can sense a voltage applied between both ends of the safety relay 180.

In the relay resting interval of the cooking appliance 100, if a preset voltage is sensed by the detecting unit 190, the voltage sensed by the detecting unit 190 may become a preset voltage supplied by the commercial electricity. This means that at least one of a plurality of the load relays 170 is malfunctioning. In particular, if at least one of a plurality of the load relays 170 is short-circuited, the preset voltage can be sensed by the detecting unit 190 instead of 0V.

In this case, the controller 150 can control the display unit 130 to display a malfunction indication (e.g., 'short-circuit indication'). If a user sees the malfunction indication displayed on the display unit 130, the user can determine a presence or non-presence of malfunction of at least one of a plurality of the load relays 170.

Moreover, the cooking appliance 100 according to the present invention may further include a power supply unit 160 configured to supply power to a plurality of the load relays 170.

After the malfunction indication has been displayed on the display unit 130, the controller 150 can control the power supply unit 160 to stop driving the power supply unit 160.

If the power supply unit 160 stops being driven, the cooking appliance 100 stops being driven as well. Hence, it is able to prevent the outbreak of fire or the like due to malfunction (i.e., short-circuit) generated from a plurality of the load relays 170.

A configuration of the controller 150 for detecting malfunction (e.g., short-circuit, non-actuation, etc.) generated from a plurality of the load relays 170 on driving the cooking appliance 100 in diagnosing mode is described as follows.

First of all, in the diagnosing mode of the cooking appliance 100, the controller 150 can determine malfunction of non-actuation (i.e., OFF state) of a plurality of the load relays 170 as well as short-circuit malfunction of a plurality of the load relays 170.

In the operating state that all load relays including a plurality of the load relays 170 and the single safety relay 180 are controlled to be turned off, if a preset voltage is sensed by the detecting unit 190, the controller 150 can control the display unit 130 to display a malfunction indication (e.g., short-circuit indication).

In particular, in the diagnosing mode of the cooking appliance 100, if a preset voltage is sensed by the detecting unit 190 in an actuated state that all load relays are controlled to be turned off, the controller 150 can control the display unit 130 to display a malfunction indication. In this case, the malfunction indication may include a short-circuit indication.

After a control signal for turning on a load relay connected to a specific load has been inputted, if a preset voltage is not sensed by the detecting unit 190 in a state that the safety relay 180 is turned off, the controller 150 can control the display unit 130 to display information on malfunction of the load relay connected to the specific load.

In particular, after a control signal for turning on a load relay connected to a specific load has been inputted, if a voltage of 0 V is sensed by the detecting unit 190 in a state that the safety relay 180 is turned off, the controller 150 can control the display unit 130 to display a malfunction indication (e.g., non-actuation indication) of the load relay connected in series to the specific load.

For instance, in FIG. 4, after a control signal for turning on the first load relay 170-1 has been inputted, if a voltage of 0 V is sensed by the detecting unit 190 in a state that the rest of the load relays 170-2 and 170-3 and the safety relay 180 are turned off, the controller 150 can control the display unit 130 to display a malfunction indication (e.g., non-actuation indication) of the first load relay 170-1.

Thus, in the operating mode of the cooking appliance 100 for driving at least one load 120 in response to user's drive command input and the diagnosing mode of the cooking appliance in response to user's diagnosis command input, a presence or non-presence of malfunction of a plurality of the load relays 170 can be detected by the single safety relay 180 and the detecting unit 190 connected in parallel with the safety relay 180.

Malfunction detecting circuit according to another embodiment of the present invention is described with reference to other drawings as follows.

Figure 5:
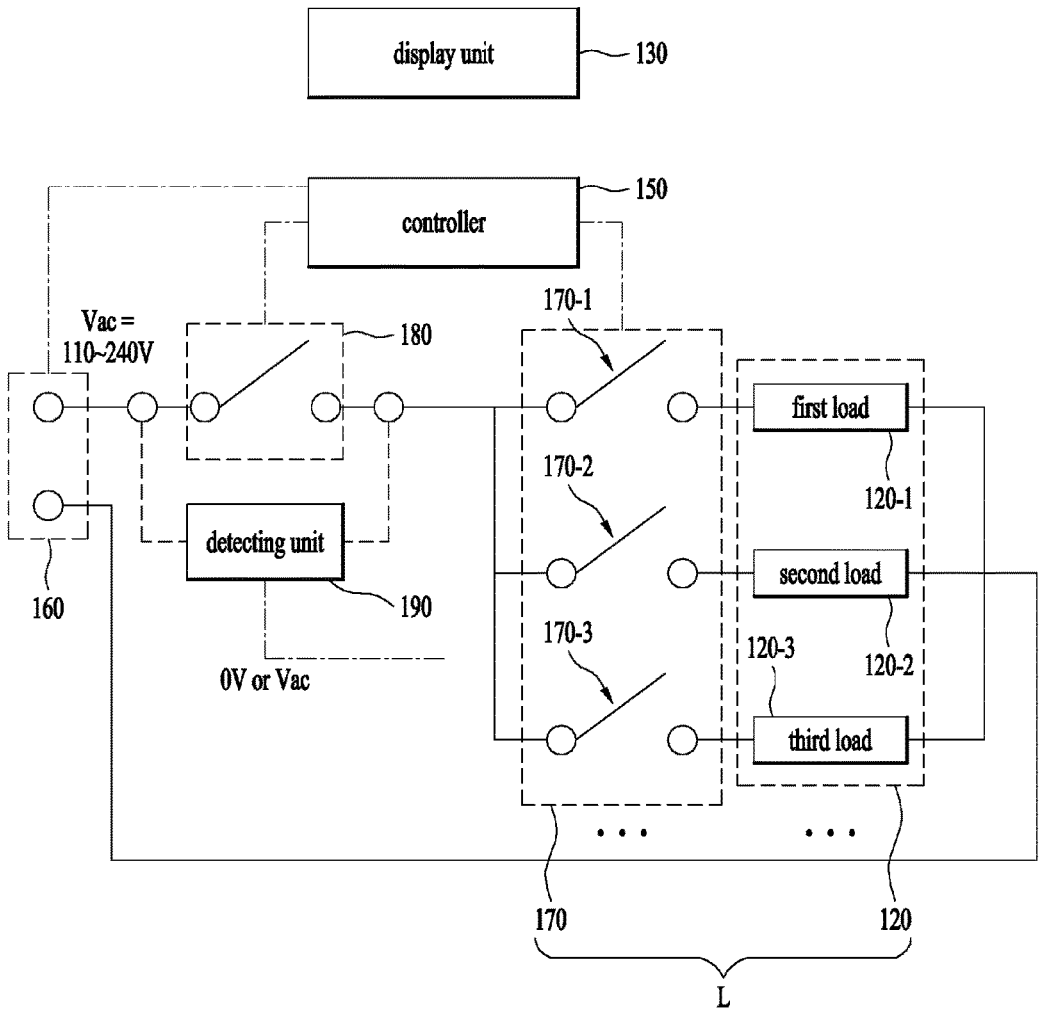
FIG. 5 is a schematic diagram for configuration of a malfunction detecting circuit according to another embodiment of the present invention.

FIG. 5 is a schematic diagram for configuration of a malfunction detecting circuit according to another embodiment of the present invention.

First of all, in describing a malfunction detecting circuit according to another embodiment of the present invention with reference to FIG. 5, parts different from those of the former embodiment shown in FIG. 4 shall be described.

Referring to FIG. 5, a safety relay 180 and a plurality of loads 120 are connected in series to each other and a detecting unit 190 is connected in parallel with the safety relay 180, which is similar to the former configuration according to the embodiment shown in FIG. 4.

Yet, the disposition of the safety relay 180 is different from that of the former safety relay shown in FIG. 4.

In particular, according to the present embodiment, the safety relay 180 can be connected in series to a plurality of the loads 120 at the front end of a plurality of the loads 120 connected in parallel with each other.

In more particular, a plurality of the loads 120 and a plurality of the load relays 170 can configure a load driving unit L and a single safety relay 180 can be connected in series to the load driving unit L at the front end of the load driving unit L.

Namely, according to the embodiment shown in FIG. 4, the safety relay 180 is disposed on the opposite side of the load relay 170 with reference to the load 120. On the contrary, according to the embodiment shown in FIG. 5, the safety relay 180 is disposed on the same side of the load relay 170 with reference to the load 120.

Besides the disposition of the safety relay 180, since the operational principles of the safety relay 180 and the detecting unit 190 are identical to those in the description with reference to FIG. 4, their details shall be omitted.

In the following description, a method of controlling a cooking appliance according to the present invention is described with reference to other drawings.

Figure 6:
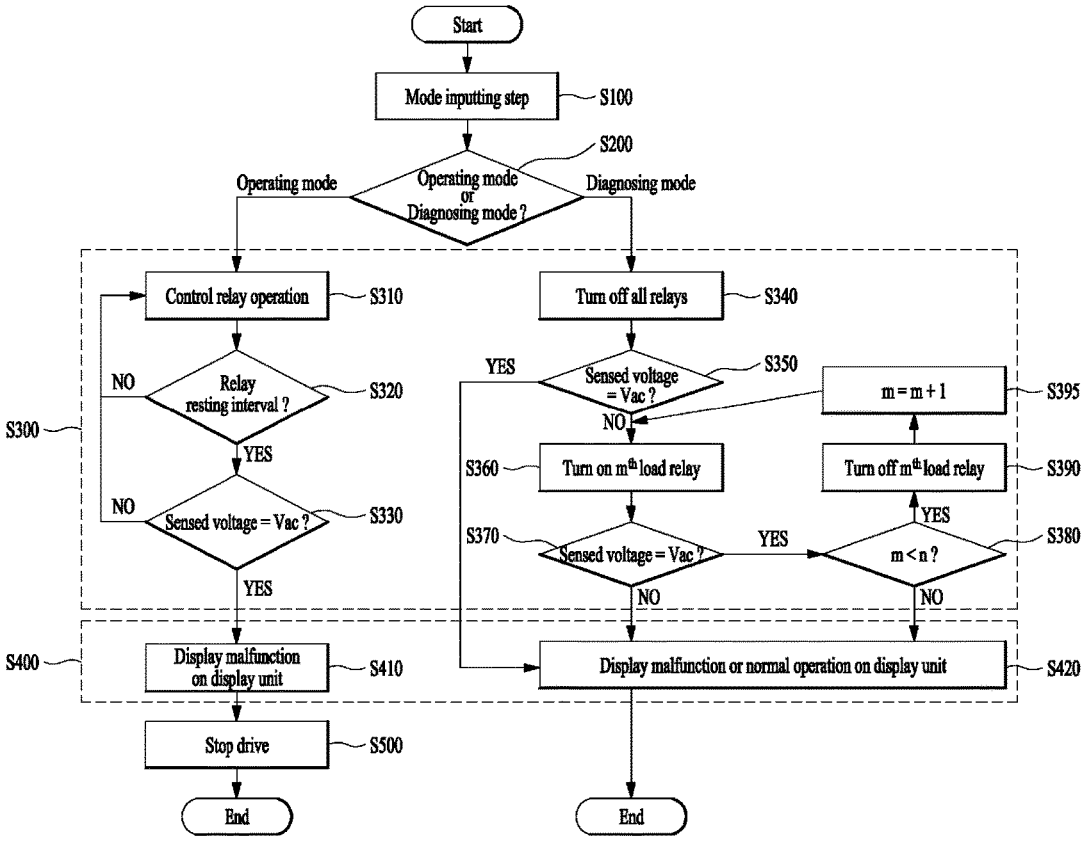
FIG. 6 is a flowchart for a method of controlling a cooking appliance according to an embodiment of the present invention.

FIG. 6 is a flowchart for a method of controlling a cooking appliance according to an embodiment of the present invention.

In describing a method of controlling a cooking appliance, it is apparent that the configuration of the cooking appliance described with reference to FIGS. 1 to 5 is applicable to the cooking appliance controlling method.

For instance, in a method of controlling a cooking appliance according to an embodiment of the present invention, the cooking appliance may include a plurality of loads 120 connected in parallel with each other, a plurality of load relays 170 connected in series to the corresponding loads, respectively, a safety relay 180 connected in series to a plurality of the loads 120, and a detecting unit 190 configured to sense malfunction of a plurality of the load relays 170 by being connected to the safety relay 180.

Referring to FIG. 6, a method of controlling a cooking appliance according to an embodiment of the present invention may include a mode inputting step S100 of inputting one of an operating mode and a diagnosing mode, a malfunction determining step S300 of determining a presence or non-presence of malfunction of a plurality of load relays based on the mode inputted in the mode inputting step S100, and a displaying step S400 of selectively displaying a presence or non-presence of the malfunction on a display unit 130 based on a result of the determination in the determining step S300.

In the mode inputting step S100, one of the operating mode and the diagnosing mode can be inputted by a user. The input of the operating mode means that a driving command for at least one of a plurality of the loads 120 is inputted by the user. And, the diagnosing mode means a mode for diagnosing a presence or non-presence of malfunction of a plurality of the load relays 170 without a driving command for the load.

And, the method of controlling the cooking appliance according to the embodiment of the present invention may further include a mode determining step S200 between the mode inputting step S100 and the malfunction determining step S300.

In the mode determining step S200, the controller 150 can determine whether the mode inputted by the user is the operating mode or the diagnosing mode.

<Load Relay Malfunction Detection in Operating Mode>

A specific operating mode may be inputted by a user in the mode inputting step S100.

In this case, the malfunction determining step S300 may include a relay operation controlling step S310 of driving the at least one load relay 170 and the single safety relay 180 in ON or OFF state selectively, a resting interval determining step S320 of determining whether it is a resting interval in which a plurality of the load relays 170 and the safety relay 180 are entirely turned off, and a first voltage detection determining step S330 of if the resting interval is determined, determining whether a preset voltage is sensed by the detecting unit 190.

In the relay operation controlling step S310, at least one of a plurality of the load relays 170 can be selectively driven according to the operating mode inputted by the user.

In particular, the user can input an actuation command for at least one of a plurality of the loads 120. In doing so, it is able to control at least one load relay, which corresponds to the at least one load, to be selectively turned on. For instance, the corresponding at least one load relay may be configured to repeat ON state and OFF state based on a preset load temperature limit.

In the resting interval determining step S320, the controller 150 can determine whether a corresponding interval is a resting interval in which both a currently driven load relay and a safety relay are turned off.

In the first voltage detection determining step S330, if the resting interval is determined in the resting interval determining step S320, the controller 150 can determine whether a preset voltage is sensed by the detecting unit 190.

If the preset voltage is detected by the detecting unit 190 in the first voltage detection determining step S330, it may mean that at least one of a plurality of the load relays 170 is malfunctioning.

In particular, since the detecting unit 190 detects voltage in the resting interval in which all relays are turned off, if all relays operate normally, a voltage of 0 V should be sensed by the detecting unit 190.

Yet, in the resting interval, if the voltage sensed by the detecting unit 190 is not 0 V but a preset voltage Vac supplied from a used power source, it may mean that at least one of a plurality of the load relays 170 is short-circuited.

Hence, according to the embodiment of the present invention, if the preset voltage is detected by the detecting unit 190 in the first voltage detection determining step S330, information on relay malfunction can be displayed on the display unit 130 in the displaying step S400 [S410].

In this case, the information on the relay malfunction displayed on the display unit 130 may include a relay short-circuit state.

The method of controlling the cooking appliance according to the embodiment of the present invention may further include a drive stopping step S500 of stopping a drive of the cooking appliance 100 based on the information (i.e., short-circuit state) on the relay malfunction displayed on the display unit 130.

In particular, in the drive stopping step S500, if the information on the relay malfunction is displayed on the display unit 130 in the displaying step S400, the controller 150 can control the power supply unit 160 to stop the drive of the power supply unit 160 supplying power to the cooking appliance 100.

Therefore, it is able to prevent the outbreak of fire due to short-circuit occurrence in at least one of a plurality of the load relays 170.

<Load Relay Malfunction Detection in Diagnosing Mode>

First of all, in diagnosing mode, the safety relay 180 can be always maintained in OFF state (i.e., open state).

In the mode inputting step S100, the diagnosing mode can be inputted by a user. Moreover, in the mode determining step S200, the controller 150 can determine that the mode inputted by the user is the diagnosing mode.

In this case, the malfunction determining step S300 may include a relay OFF step S340 of turning off a plurality of the load relays 170 and the single safety relay 180 by the controller 150 and a second voltage detection determining step S350 of determining a voltage sensed by the detecting unit 190.

First of all, in the relay OFF step S340, a plurality of the load relays 170 and the single safety relay 180 can be controlled to be turned off entirely.

In the second voltage detection determining step S350, the controller 150 can determine whether a preset voltage is sensed by the detecting unit 190 connected in parallel with the safety relay 180.

In the second voltage detection determining step S350, if the preset voltage is sensed by the detecting unit 190, it may mean that at least one of a plurality of the load relays 170 is malfunctioning.

In particular, in the second voltage detection determining step S350, if a voltage of 0 V is sensed by the detecting unit 190, it may mean that each of a plurality of the load relays 170 is operating normally (i.e., each of a plurality of the load relays 170 is not short-circuited).

So to speak, if at least one of a plurality of the load relays 170 is short-circuited, the preset voltage can be sensed by the detecting unit 190 in the second voltage detection determining step S350.

In doing so, if the preset voltage is sensed by the detecting unit 190 in the second voltage detection determining step S350, information on the relay malfunction may be displayed on the display unit in the displaying step S400. In this case, the information on the relay malfunction may include a relay short-circuit state.

Meanwhile, the malfunction determining step S300 may further include a load relay ON step S360 of if the voltage sensed by the detecting unit 190 is 0 V in the second voltage detection determining step S350, inputting a signal for turning on the first load relay among a plurality of the load relays 170 and a third voltage detection determining step S370 of determining whether a voltage is sensed by the detecting unit 190.

In the load relay ON step S360, a signal for turning on one of a plurality of the load relays 170 can be inputted from the controller 150. For instance, in the load relay ON step S360, a signal for turning on the first load relay among a plurality of the load relays 170 can be inputted. In doing so, the safety relay 180 can be maintained in OFF state (i.e., open state).

In the embodiment shown in the drawing, the initial 'm' may mean '1' in the load relay ON step S360. In a step S380, 'n' may become the total number of the loads.

In the third voltage detection determining step S370, the voltage sensed by the detecting unit 190 connected in parallel with the safety relay 180 can be determined by the controller 150.

In this case, if the voltage sensed by the detecting unit 190 is 0 V in the third voltage detection determining step S370, it means that the load relay having received an ON signal from the controller 150 is malfunctioning.

In particular, if a signal for turning on the first load relay is inputted in the load relay ON step S360 and the voltage sensed by the detecting unit 190 is 0 V in the third voltage detection determining step S370, it may mean that the first load relay is malfunctioning.

In this case, information on the relay malfunction may be displayed on the display unit 130 in the displaying step S400 [S420]. And, the information on the load relay malfunction displayed on the display unit 130 may become 'load relay non-actuated state'.

For instance, if a signal for turning on the first load relay is inputted in the load relay ON step S360 and the voltage sensed by the detecting unit 190 is 0 V in the third voltage detection determining step S370, 'first load relay un-actuated state' can be displayed on the display unit 130 in the displaying step S400 [S420].

Meanwhile, if a preset voltage is sensed by the detecting unit 190 instead of 0 V in the third voltage detection determining step S370, a signal for turning on the second load relay as well as turning off the first load relay can be inputted [S380, S390, S395]. And, the routine may go back to the third voltage detection determining step S370.

In doing so, if the voltage sensed by the detecting unit 190 is 0 V in the third voltage detection determining step S370, 'second load relay non-actuated state' can be displayed on the display unit 130 in the displaying step S400 [S420].

Moreover, if a preset voltage is sensed by the detecting unit 190 instead of 0 V in the third voltage detection determining step S370, a signal for turning off the second load relay as well as turning on the third load relay can be inputted [S380, S390, S395]. And, the routine may go back to the third voltage detection determining step S370.

Thus, in the third voltage detection determining step S370, the determination of a presence or non-presence of malfunction of every load relay can be made iteratively and subsequently.

In other words, the determination of a presence or non-presence of malfunction for each of a plurality of the load relays 170 can be performed through the third voltage detection determining step S370 in sequence.

In particular, the determination of a presence or non-presence of non-actuation of each of n load relays 170 can proceed through the voltage detection determining step S370 in sequence.

In doing so, as a result of the determination of a presence or non-presence of non-actuation of the n load relays 170, if all of the n load relays 170 are determined as normal actuation through the third voltage detection determining step S370, information on the normal actuations of all relays can be displayed on the display unit 130 in the displaying step S400 [S420].

Therefore, a presence or non-presence of malfunction (short-circuit occurrence) of the load relay 170 in the operating mode of the cooking appliance 100 and a presence or non-presence of malfunction (short-circuit occurrence) of the load relay 170 in the diagnosing mode of the cooking appliance 100 can be easily and conveniently detected through the single safety relay 180 and the single detecting unit 190.

It will be appreciated by those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A cooking appliance, comprising:
- a plurality of loads connected in parallel with each other;
- a plurality of load relays configured to be connected in series to a plurality of the loads in order to selectively supply commercial electricity supplied from a power supply to a plurality of the loads, respectively and be driven selectively in ON or OFF state;
- a safety relay configured to be connected in series to a plurality of the loads and be driven selectively in ON or OFF state;
- a detector configured to sense a voltage applied to both ends of the safety relay by being connected to the safety relay; and
- a controller configured to control a plurality of the load relays, the safety relay and the detector and determine a presence or non-presence of malfunction of a plurality of the load relays based on a signal from the detector.

2. The cooking appliance of claim 1, further comprising a display configured to display the presence or non-presence of the malfunction of the load relay based on a signal from the controller.

3. The cooking appliance of claim 2, wherein in an operating mode of the cooking appliance, if a preset voltage is sensed by the detector in a relay resting interval having all load relays controlled to be turned off, the controller controls the display to display a malfunction indication.

4. The cooking appliance of claim 3, further comprising a power supply configured to supply power toward the load and wherein the controller controls the power supply to stop a drive of the power supply after displaying the malfunction indication on the display.

5. The cooking appliance of claim 2, wherein in a diagnosing mode of the cooking appliance, if a preset voltage is sensed by the detector in an operating state having all load relays controlled to be turned off, the controller controls the display to display a malfunction indication.

6. The cooking appliance of claim 5, wherein after a control signal for turning off a load relay connected to a specific load has been inputted, if a voltage of 0 V is sensed by the detector in a state that the safety relay is turned off, the controller controls the display to display information on malfunction of the load relay connected to the specific load.

7. The cooking appliance of claim 1, wherein a plurality of the loads and a plurality of the load relays configure a load driving unit, wherein the safety relay is a single safety relay that is connected in series to the load driving unit at a front or rear end of the load driving unit.

8. The cooking appliance of claim 1, wherein the detector comprises a voltage sensing unit configured to sense a voltage between both ends of the safety relay by being connected in parallel with the safety relay.

9. In a cooking appliance including a plurality of loads connected in parallel with each other, a plurality of load relays connected in series to the corresponding loads, respectively, a single safety relay connected in series to a plurality of the loads, and a detector configured to sense malfunction of a plurality of the load relays by being connected to the safety relay, a method of controlling the cooking appliance, comprising:

a mode inputting step of inputting either an operating mode or a diagnosing mode;

a malfunction determining step of determining a presence or non-presence of malfunction of the plurality of load relays based on the inputted mode; and a displaying step of selectively displaying the presence or non-presence of the malfunction based on a result of the determination in the malfunction determining step.

10. The method of claim 9, wherein if a specific operating mode is inputted in the mode inputting step, the malfunction determining step comprises a relay operation controlling step of driving at least one of a plurality of the load relays and the single safety relay in the inputted operating mode selectively, a resting interval determining step of determining whether it is a resting interval in which the plurality of load relays and the safety relay are entirely turned off, and a first voltage detection determining step of if the resting interval is determined, determining whether a preset voltage is sensed by the detector.

11. The method of claim 10, wherein if the preset voltage is sensed by the detector in the first voltage detection determining step, information on relay load malfunction is displayed on the display in the displaying step.

12. The method of claim 11, wherein the information on the load relay malfunction displayed on the display comprises a relay short-circuit state.

13. The method of claim 12, further comprising a drive stopping step of if the information on the relay load malfunction is displayed on the display in the displaying step, stopping a drive of a power supply configured to supply power to the cooking appliance.

14. The method of claim 9, wherein if a diagnosing mode is inputted in the mode inputting step, the malfunction determining step comprises a relay OFF step of turning off the plurality of load relays and the single safety relay and a second voltage detection determining step of determining whether a preset voltage is sensed by the detector.

15. The method of claim 14, wherein if the preset voltage is sensed by the detector in the second voltage detection determining step, information on relay load malfunction is displayed on the display in the displaying step.

16. The method of claim 15, wherein the information on the load relay malfunction displayed on the display comprises a relay short-circuit state.

17. The method of claim 14, the malfunction determining step further comprising:

a load relay ON step of if the voltage sensed by the detector is 0 V in the second voltage detection determining step, inputting a signal for turning on a first load relay among a plurality of the load relays; and a third voltage detection determining step of determining whether a preset voltage is sensed by the detector.

18. The method of claim 17, wherein if a voltage sensed by the detector is 0 in the third voltage detection determining step, information on relay load malfunction is displayed on the display in the displaying step.

19. The method of claim 18, wherein the information on the load relay malfunction displayed on the display comprises a load relay non-actuation state.

20. The method of claim 17, wherein if the preset voltage is sensed by the detector in the third voltage detection determining step, after a signal for turning off the first load relay and turning on the second load relay has been inputted, the third voltage detection determining step is entered.

* * * * *